US005975274A

United States Patent [19]

Novak et al.

[11] Patent Number: 5,975,274

[45] Date of Patent: Nov. 2, 1999

[54] NOTE ACCEPTOR SECURITY SYSTEM

[75] Inventors: Frank A. Novak, Kirtland Hills; Claude Abraham, Stow, both of Ohio

[73] Assignee: Ardac Incorporated, Eastlake, Ohio

[21] Appl. No.: 09/058,999

[22] Filed: Apr. 13, 1998

[51] Int. Cl.[6] ..... G07F 7/04; E05G 1/00

[52] U.S. Cl. ..... 194/206; 902/9

[58] Field of Search ..... 194/206; 902/12, 902/13, 9; 174/51; 361/212, 220, 760; 257/726, 727

[56] References Cited

U.S. PATENT DOCUMENTS

| | | | |
|---|---|---|---|
| 5,012,075 | 4/1991 | Hutchison et al. | 902/13 |
| 5,056,643 | 10/1991 | Kirberg | 902/13 |
| 5,105,364 | 4/1992 | Kawamura et al. | 902/13 |
| 5,784,254 | 7/1998 | Stephan et al. | 257/727 |

*Primary Examiner*—F. J. Bartuska
*Assistant Examiner*—Bryan Jaketic
*Attorney, Agent, or Firm*—Renner, Kenner, Greive, Bobak, Taylor & Weber

[57] ABSTRACT

A note acceptor security system includes a currency validator secured to a housing and a note stacker removably received thereby. The currency validator has an identification chip maintained in association therewith and having a fixed serial number. The currency validator also includes a microprocessor which controls the operation of the currency validator and maintains operational data respecting the same. The stacker has a memory chip which is urged into a grounded position which is removed when the stacker is placed into the note acceptor. A fixed probe within the note acceptor lifts the memory chip from ground and allows communication from the microprocessor and identification chip to the memory chip. When the stacker is full, it is removed from the note acceptor and, with the memory chip grounded, it is transported to a docking station where the memory chip is again probed and the data maintained therein is transferred to a personal computer for later use. The memory chip is then erased and the stacker made available for reuse.

12 Claims, 1 Drawing Sheet

NOTE ACCEPTOR SECURITY SYSTEM

TECHNICAL FIELD

The invention herein resides in the art of currency validators or note acceptors, particularly of the slot acceptor type. More specifically, the invention relates to note acceptors having security systems to provide correlations between the amount of money received by the note acceptor and that deposited into an associated stacker. Specifically, the invention relates to a note acceptor security system in which a portable stacker maintains a memory chip which communicates with an identification chip maintained by the currency validator, such that correlations can be made between the amount of money processed by the currency validator and that received by the stacker.

BACKGROUND ART

The use of note acceptors in association with various vending machines for goods and services is now well known. Specifically, a note acceptor may be associated with a vending machine or gaming machine such that the deposit of currency into the validator results in an authorization for the vending of goods and/or services from the vending machine or gaming machine. Note acceptors must be serviced periodically to retrieve the currency received thereby, and to assure that a full complement of change is available for return to customers.

Typically, service personnel access the note acceptor and retrieve the currency received therein by simply removing the cash box or stacker full of bills and replacing it with an empty one. At the same time, necessary change may be deposited into the note acceptor. The full cash box cassette is then returned to a service area where the money is removed and counted. However, such a process is given to temptation of theft, since inaccuracies in the amount actually received by the note acceptor and that retrieved from the stacker are difficult of make. Moreover, information concerning the operational history of the associated note acceptor is typically not available, apart from a manual count of the money received. Information respecting the experience of a currency validator with respect to jams, attempts at illegal retrieval or "stringing," or the number of rejections of paper tendered as valid currency remain unknown, but of interest.

In the prior art, it has been known to provide an apparatus and technique for generally associating a currency stacker with a particular currency validator in the context of a note acceptor, such that a count of money received, as well as other operating parameters, can be determined at the time of service by monitoring a memory chip maintained in the note stacker. However, it has been found that such memory chips are given to failure because of static charges which may strike them during transportation. Typically, many such memory chips are insulated from electrical shocks up to 11,000 volts, while the static charges generated from the carpet often reach levels of 22,000 volts or more. Charges of this amplitude can either destroy the data maintained within the memory chip, or destroy the memory chip itself. Since it is most desirable that the note stackers be transported in an environment necessarily conducive to the existence of static charges, there is a need in the art for a structure which assures that the memory chip maintained by the note stacker is properly grounded during times of transport, and only removed from the electrical ground for data transmission when maintained in the currency validator itself, or at an appropriate docking station where the memory is to be read.

DISCLOSURE OF INVENTION

In light of the foregoing, it is a first aspect of the invention to provide a note acceptor security system in which the note stacker of the note acceptor has a memory chip associated therewith, the memory chip being grounded at all times when the data transmission is not intended.

Another aspect of the invention is the provision of a note acceptor security system where in memory chip maintained by the note stacker communicates with a currency validator of an associated note acceptor to receive data respecting the operation of the note acceptor, including the amount of currency received by the stacker.

Still another aspect of the invention is the provision of a note acceptor security system in which placement of the note stacker in either a note acceptor or in a docking station allows data communication with an associated memory chip.

Yet an additional aspect of the invention is the provision of a note acceptor security system which is reliable and durable in operation, while being easy to construct with state of the art materials and techniques.

The foregoing and other aspects of the invention which will become apparent as the detailed description proceeds are achieved by a note acceptor security system, comprising: a housing; a currency validator received within said housing; a stacker removably received within said housing and in currency receiving communication with said currency validator; an identification chip maintained in association with said currency validator; a memory chip attached to said stacker and in data communication with said identification chip, said memory chip being biased toward grounded contact with said stacker; and a first contact probe interconnected with said identification chip and urging said memory chip from said grounded contact, said identification chip passing a serial number associated with said currency validator from said identification chip to said memory chip.

BRIEF DESCRIPTION OF THE DRAWINGS

For a complete understanding of the objects, techniques and structure of the invention, reference should be made to the following detailed description and accompanying drawings wherein.

BEST MODE FOR CARRYING OUT THE INVENTION

Figure 1:
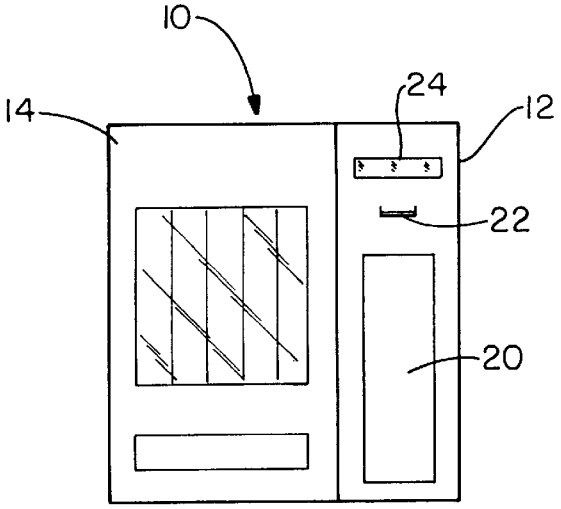
FIG. 1 is an illustrative front plan view of a vending machine incorporating a note acceptor made in accordance with the invention.

Referring now to the drawings and more particularly FIG. 1, it can be seen that a vending machine assembly made in accordance with invention is designated generally by the numeral 10. The vending machine 10 has associated therewith a note acceptor 12, adapted for receiving paper currency, coupons, and the like which are tendered in exchange for goods or services from the vending machine 10. It will be appreciated that the vending machine 14 provides goods in the form of food, snacks, beverages, or the like in return for the currency or coupons received by the note acceptor. Alternatively, the vending machine 14 may provide services such as video game playtime, water and vacuum at a self-serve carwash, play on a gaming machine, or the like.

Figure 2:
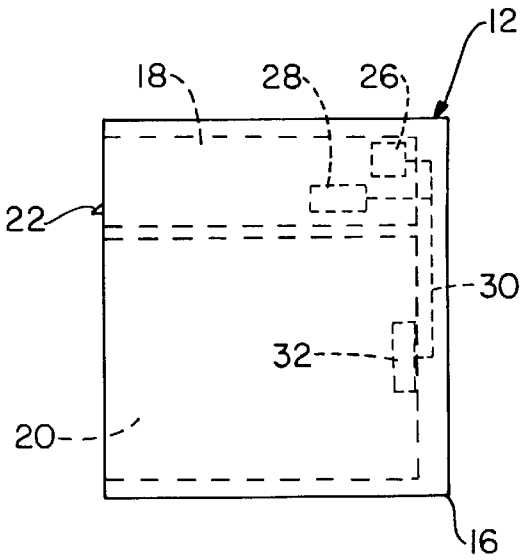
FIG. 2 is a side illustrative view of the note acceptor of the invention.

As shown in FIG. 2, the note acceptor 12 consists of a casing or housing 16 having a currency validator 18 and a stacker 20 received therein. The currency validator 18 has a slot infeed 22, typically provided with a note guide for the receipt of currency, coupons, or the like for validation. In the event that the tendered paper is not valid, it is rejected out of the slot 22. When validated, the paper is passed from the currency validator 18 to the stacker 20 where it is maintained until retrieved by authorized service personnel. The currency validator 18 is provided with an appropriate display 24, typically a liquid crystal display, to provide an indication of value tendered. The display 24 is best seen in FIG. 1.

Associated with the currency validator 18, and preferably secured thereto, is a read only memory (ROM) chip 26 having a serial number permanently maintained therein. That serial number serves to identify the currency validator 18 in that it is either secured directly to the currency validator 18, or to the housing 16 to which the currency validator 18 is secured. Also included as part and parcel of the currency validator 18 is a microprocessor 28 which serves to control the operation of the currency validator and generates data respecting its operation, as is know to those skilled in the art. Typically, the microprocessor 28 records data respecting the amount of money/coupons received by the currency validator 18, the number of various denominations so received, the number of jams encountered by the currency validator 18, the number of attempts to string or otherwise illegally defeat the validator and the number of rejects of tendered paper. In addition, the micro processor 28 records the amount of time that the stacker 20 was maintained within the note acceptor 12 before being removed and exchanged for an empty one. A data output line or cable 30 extends from the microprocessor 28 and identification chip 26 to a memory chip 32 mounted to and maintained by the stacker 20. The output line 30 provides for the serial transfer of data from the identification chip 26 and microprocessor 28 to the memory chip 32. Of course, the data transmitted from the identification chip 26 is the serial number of the associated currency validator 18, the transfer being made immediately upon insertion of a stacker 20 into the housing 16. The data transmitted from the microprocessor 28 to the memory chip 32 is that data described directly above respecting operation of the currency validator 18.

Figure 3:
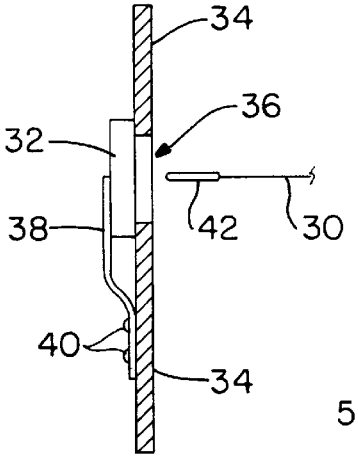
FIG. 3 is a cross sectional view of the casing of the note stacker of the invention, showing the mounting of a memory chip therein.

As shown in FIG. 3, the casing or housing 34 of the stacker 20 is provided with an aperture 36 at the rear thereof. The casing 34 is of metallic construction and is electrically grounded. A leaf spring 38 or other appropriate spring mechanism is secured by bolts or pins 40 to the housing 34 at one end thereof with the other end thereof urging the memory chip 32 into grounded contact with the housing 34. In this regard, it will be appreciated that the interconnection between the leaf spring 38 and the housing 34 is insulated.

A contact probe 42 is maintained in a fixed position opposite the aperture 36 and is interconnected with the output line 30. In operation, when an empty stacker 20 is placed into the housing 16 and slid to a "home" position, the contact probe 42 engages the memory chip 32 and disengages it from its grounded position against the housing 34 such that data communication can be made between the memory chip 32 and the identification chip 26 and microprocessor 28. This communication proceeds the entire time that the stacker 20 is received within the housing 16, with the memory chip 32 being lifted from ground by contacting engagement with the contact probe 42.

At predetermined intervals, or when an indicator advises that the stacker 20 is full, the stacker 20 is removed from the note acceptor 12 for transport to a remote area for removal of the currency/coupons and acquisition of data maintained by the memory chip 32. Immediately upon withdrawing movement of the stacker 20 from the housing 16, the spring 38 closes the memory chip 32 upon the grounded casing 34 such that no static electrical charges can impinge upon the memory 32 and either destroy it or erase its contents. Accordingly, during all periods of time that the stacker 20 is being transported, the memory chip 32 is safely grounded.

Figure 4:
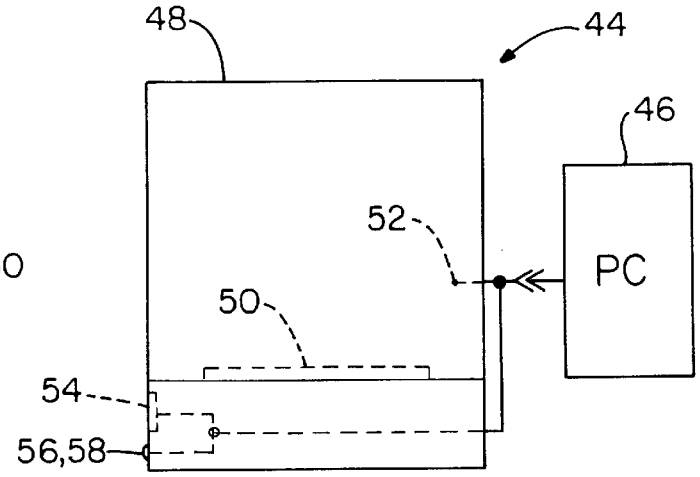
FIG. 4 is an illustrative side view of a docking station made in accordance with the invention.
Figure 5:
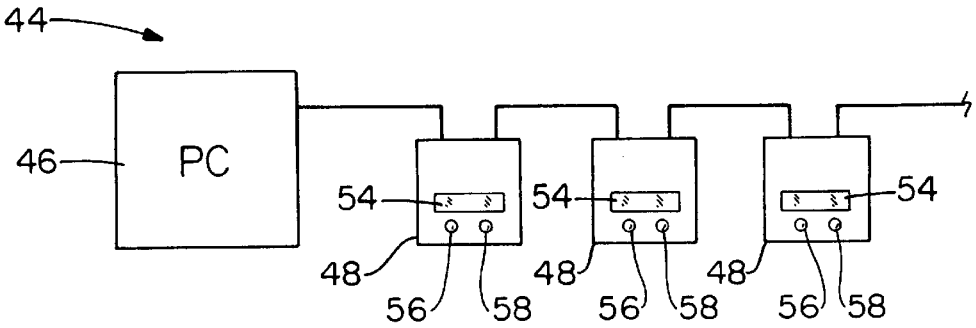
FIG. 5 is an illustration of the docking/reading system made in accordance with the invention.

Upon removal from the note acceptor 12, the stacker 20 is transported to a remote area where the currency/coupons are removed and counted. As shown in FIGS. 4 and 5, the stacker 20 is then received by a docking/reading system 44 which includes a personal computer 46 or other appropriate computer structure for reading of the data from the memory chip 32 and for clearing and resetting the same. The docking/reading system 44 includes a plurality of docking stations 48. Each of the docking stations 48 includes a track 50 adapted to slidingly receive a stacker 20. A contact probe 52 communicates with the personal computer 46 and is fixedly maintained at a rear portion of the docking station 48 such that when the stacker 20 is slid to a "home" position within the docking station 48, the contact probe 52 engages the memory chip 32 and lifts it from its grounded position against the housing 34 such that communication may be made between the memory chip 32 and the personal computer 46. The personal computer 46 reads the serial number of the associated currency validator 18 and all of the operational data associated therewith and stores it for later use for logistic purposes. The operational efficiency of any particular currency validator 18 can then be determined from this data over any course of time. Once the data has been transferred from the memory chip 32 to the personal computer 46, the memory chip 32 is erased such that the associated stacker 20 can be replaced in any note acceptor 12 associated with any vending machine 14, receive the serial number from the identification chip 26 of the associated currency validator 18, and again proceed to acquire operational data as presented above.

It will be appreciated that a liquid crystal display 54 is provided with each of the docking stations 48. The personal computer 46 may present upon the liquid crystal display 54 the serial number of the currency validator 18 last associated with the stacker 20 then received within the docking station. The display 54 may also post other data of immediate interest, such as the amount of currency recorded therein. A check may then be made against the amount of currency/coupons so recorded and the value of the currency/coupons actually received and manually counted.

It will also be seen that each of the docking stations 48 is provided with appropriate lamps 56, 58, preferably a red light emitting diode (LED) 56 and a green LED 58. Illumination of the green LED 58 indicates that the docking station 48 is available for receipt of a stacker 20, while illumination of the red LED 56 indicates that the data has been transferred from the memory chip 32 to the personal computer 46 and has been erased for reuse of the associated stacker 20.

Thus it can be seen that the objects of the invention have been satisfied by the structure presented above. While in accordance with the patent statutes only the best mode and preferred embodiment of the invention has been presented in detail, it is to be understood that the invention is not limited thereto or thereby. Accordingly, for an appreciation of the true scope and breadth of the invention reference should be made to the following claims.

What is claimed is:

1. A note acceptor security system, comprising:

a housing;

a currency validator received within said housing;

a stacker removably received within said housing in currency receiving communication with said currency validator;

an identification chip maintained in association with said currency validator;

a memory chip attached to said stacker and in data communication with said identification chip, said memory chip being biased toward grounded contact with said stacker; and a first contact probe interconnected with said identification chip and urging said memory chip from said grounded contact, said identification chip passing a serial number associated with said currency validator from said identification chip to said memory chip.

2. The note acceptor security system according to claim 1, wherein said memory chip is biased toward grounded contact with said stacker by a spring.

3. The note acceptor security system according to claim 2, wherein said stacker comprises a casing having an aperture therein, said memory chip being biased by said spring to close said aperture.

4. The note acceptor security system according to claim 3, wherein said spring comprises a leaf spring fixed at one end to said casing and in contacting engagement with said memory chip at an opposite end.

5. The note acceptor security system according to claim 4, wherein said first contact probe is fixed in position opposite said aperture.

6. The note acceptor security system according to claim 3, further comprising a micro processor maintained within said currency validator, said micro processor controlling operation of said currency validator and maintaining data respecting such operation, said micro processor being in data communication with said memory chip through said first contact probe.

7. The note acceptor security system according to claim 6, further comprising a docking and reading system adapted to receive stackers and obtain therefrom said serial number and data respecting said currency validator associated with said serial number.

8. The note acceptor security system according to claim 7, wherein said docking and reading system comprises at least one docking station having a track for receiving a stacker and a personal computer for communicating with said stacker.

9. The note acceptor security system according to claim 8, wherein said docking station has a second contact probe mounted to said docking station, said second contact probe being connected to said personal computer for data communication therewith.

10. The note acceptor security system according to claim 9, wherein said second contact probe urges said memory chip from said ground contact.

11. The note acceptor security system according to claim 10, wherein said docking station comprises an optical display for displaying said serial number and selected data of said associated currency validator.

12. The note acceptor security system according to claim 11, wherein said docking station further comprises lamps for indicating the availability of said docking station for a stacker and a status of operation of said personal computer in obtaining data from and erasing said memory chip.

* * * * *